United States Patent [19]

Elliott

[11] Patent Number: 4,517,772

[45] Date of Patent: May 21, 1985

[54] RIGID COMPUTER MEMORY DISC MANUFACTURING METHOD

[75] Inventor: Richard J. Elliott, Costa Mesa, Calif.

[73] Assignee: Charlton Associates, Irvine, Calif.

[21] Appl. No.: 560,416

[22] Filed: Dec. 12, 1983

[51] Int. Cl.[3] ..... B24B 1/00

[52] U.S. Cl. ..... 51/281 SF; 29/418; 51/323

[58] Field of Search ..... 51/290, 5 B, 323, 281 R, 51/281 SF, 111 R, 117–118; 29/418, 558, 28, 564.7; 82/1 R, 46 R, 47–48

[56] References Cited

U.S. PATENT DOCUMENTS 3,992,820 11/1976 Suter ..... 51/118

4,179,852 12/1979 Barnett ..... 51/281 SF X

*Primary Examiner*—Frederick R. Schmidt

*Assistant Examiner*—Debra S. Meislin

*Attorney, Agent, or Firm*—Spensley Horn Jubas & Lubitz

[57] ABSTRACT

A method of manufacturing a rigid computer memory disc where manufacturing operations may be simultaneously performed on both surfaces of the disc. The method that accomplishes the above is to initially provide a disc with a false inner diameter which is smaller than the desired inner diameter thereof. The space between the false inner diameter and the final inner diameter is used for clamping the disc. Thus, the whole final face is exposed for performing the various manufacturing steps.

4 Claims, 2 Drawing Figures

FIG. 1.
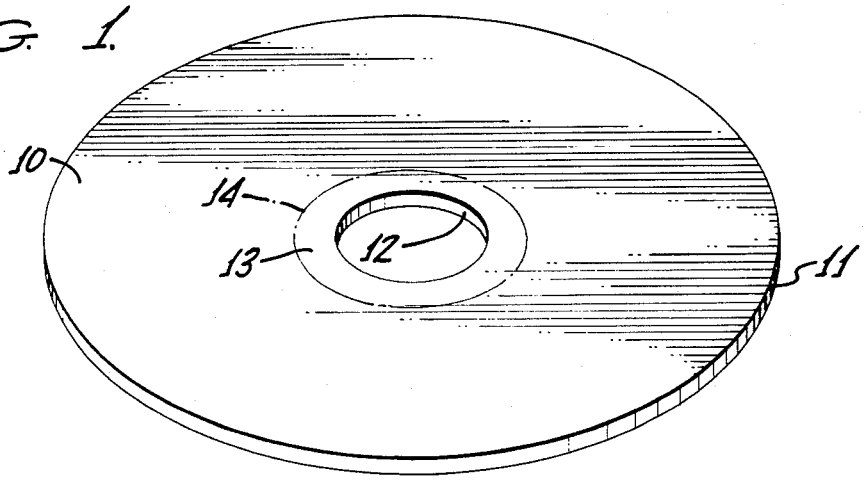
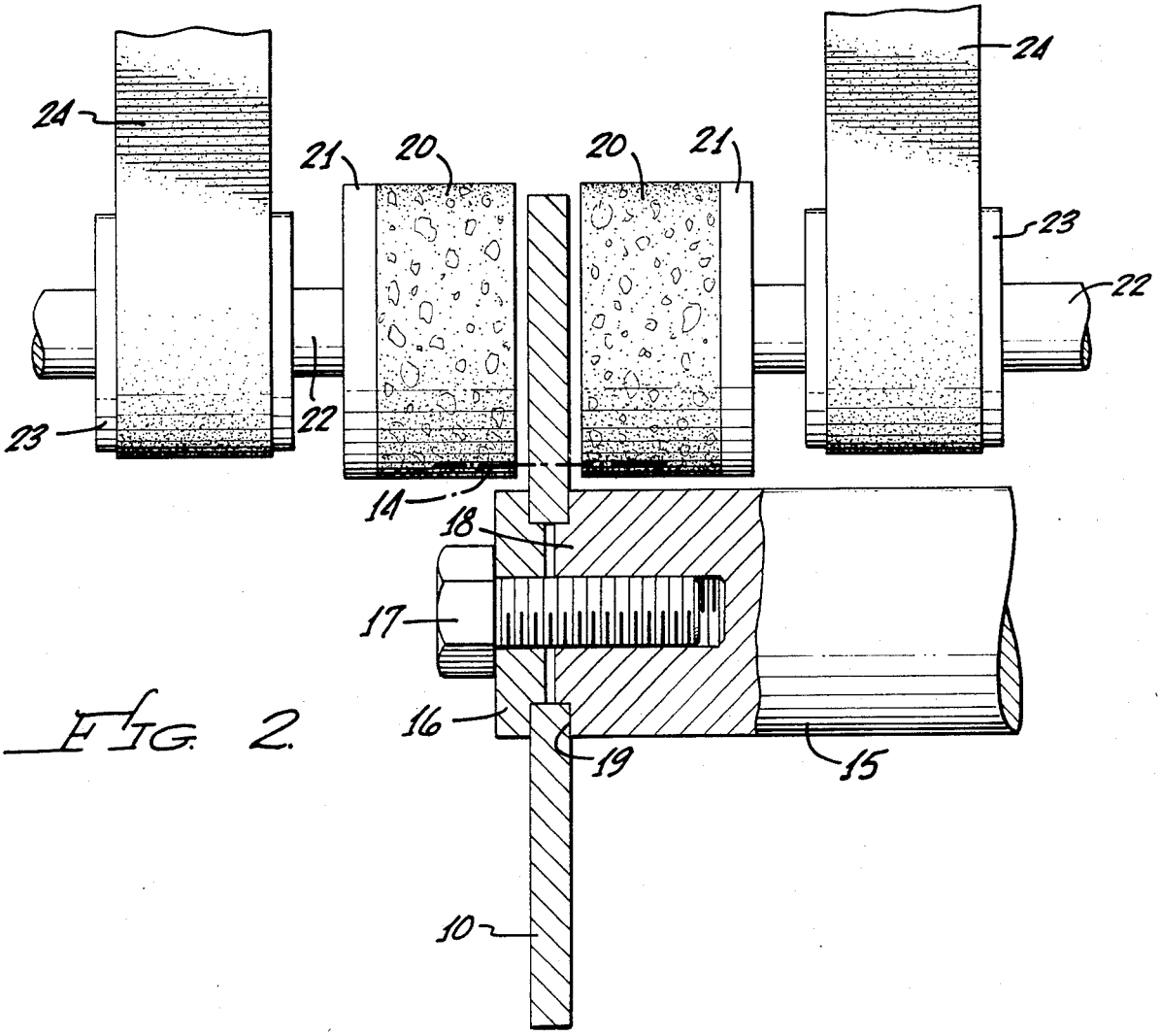
FIG. 2.

RIGID COMPUTER MEMORY DISC MANUFACTURING METHOD

BACKGROUND OF THE INVENTION

1. Field of the Invention

The present invention relates to a rigid computer memory disc manufacturing method and, more particularly, to a method of supporting a rigid computer memory disc so that manufacturing operations may be performed thereon.

2. Description of the Prior Art

The present invention relates to the manufacture of rigid computer memory discs of the type which are used with a memory apparatus of a computer for storing data thereon. These discs are typically made of an aluminum alloy, have an inner diameter of 1.576 inch, an outer diameter of 5.118 inches, and a thickness of 0.075 inch. The opposed surfaces of the discs are coated with a magnetic coating for memory use.

In the usual method of manufacturing rigid computer memory discs, the inside and outside diameters are sized to the proper dimensions. Then the faces of the disc blank are turned on a lathe and subsequently polished to a super-fine finish. Some operations, such as turning the faces on a lathe, are done using a vacuum chuck which holds one face of the disc blank while the lathe operates on the opposite face thereof. Other operations, particularly those that require operations on both faces at the same time, require that some clamping be done to the disc. Such clamping is typically done by a ring having a width of approximately 0.25 inch which holds the disc very near its inside diameter. This means that the area of the disc face that is under the clamp cannot have any operations performed on it, such as a finishing or turning operation.

These methods of manufacturing rigid computer memory discs have a number of disadvantages when a clamp is used, since the area under the clamp cannot have any operations performed thereon. If this method is used for surface finishing, a step in the surface of the disc results and this is undesirable. While this can be eliminated by using a vacuum chuck, the result here is that only one surface of the disc can be processed at one time The ability to perform operations simultaneously to both faces and over the entire surface of the disc is an advantage because it greatly reduces the time required to perform a given operation in the manufacture of a computer memory disc substrate. This has been unachievable heretofore.

SUMMARY OF THE INVENTION

According to the present invention, there is provided a method of manufacturing a rigid computer memory disc where manufacturing operations may be simultaneously performed on both surfaces of the disc. With the present manufacturing method, the disc is positively clamped so that all needed manufacturing operations can be performed on both faces simultaneously and, in particular, on the whole face of the disc.

The method that accomplishes the above is to initially provide a disc blank with a false inner diameter which is smaller than the desired inner diameter thereof. The space between the false inner diameter and the final inner diameter is used for clamping the disc. Thus, the whole final face is exposed for performing the various manufacturing steps. Then, the final operation is to remove the false inner portion, leaving the correct inner diameter of the disc.

The objects, features and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a perspective view of a disc blank of a type used in the present manufacturing method; and FIG. 2 is a simplified side elevation view of a surface finishing step in the manufacture of a rigid computer memory disc illustrating the advantage of the present invention.

DESCRIPTION OF THE PREFERRED EMBODIMENT

Referring now to the drawings and, more particularly, to FIG. 1 thereof, there is shown a disc blank, generally designated 10, as it would be provided by an aluminum supplier. Disc blank 10 is processed into a finished disc for computer memories as is well known in the art. According to the present invention, disc blank 10 has an outside diameter 11 and an inside diameter 12, inside diameter 12 being smaller than the desired inner diameter 14 which disc 10 will have when the manufacturing process is completed. Thus, the area 13 between the false inner diameter 12 and the desired inner diameter 14 may be used for clamping disc 10 so that all needed manufacturing operations can be performed on the entire face of disc 10, from the desired inner diameter 14 to outer diameter 11 and, in particular, can be done to both faces simultaneously.

FIG. 2 illustrates one example of how the present invention may be applied to a finishing process where disc 10 is clamped with sufficient holding power to furnish the required torque for the finishing process. At the same time, the whole face is available for finishing and, moreover, both faces can be finished simultaneously.

With reference now to FIG. 2, disc 10 is clamped to a spindle 15 by a clamp 16 and a screw 17. More specifically, the end of spindle 15 has a reduced diameter end 18 which extends into the center of disc 10. The shoulder 19 formed by reduced diameter end 18 rests on one side of disc 10, within area 13. Clamp 16 contacts the other side of disc 10 within area 13. Screw 17 extends through clamp 16 and into a threaded hole in spindle 15. Disc 10 is firmly and positively clamped to spindle 15 by tightening screw 17 by the required amount. Spindle 15 can now turn disc 10 with sufficient torque to overcome the restraining torque of the surface finishing process. Spindle 15 can be driven by a suitable drive means (not shown).

The process of the example shown in FIG. 2 has opposing pairs of abrasive polishing wheels 20 mounted on backings 21 which are attached to shafts 22. Shafts 22 are supported for rotation in any suitable manner (not shown). Mounted on each shaft 22 is a pulley 23 which is driven by a drive belt 24 which engages a suitable motor/pulley drive means (not shown). Suitable apparatus for simultaneously polishing both sides of disc 10 is described and claimed in copending application Ser. No. 560,417, filed concurrently herewith in the names of David A. Miller et al, entitled Force Sensor for Controlling Polishing Pad Pressure and assigned to Charlton Associates, the assignee of the present invention.

With the present invention, it is seen that polishing wheels 20 can be made of a diameter to overlap the outside diameter 11 of disc 10 and also the final inner diameter 14 of disc 10. Thus, both faces of the entire final disc size can be finished simultaneously. It will also be evident to those skilled in the art that all other steps necessary for the manufacture of a completed computer memory disc can be performed with a similar arrangement.

A number of methods and means may be used for removing area 13 between false inner diameter 12 and desired inner diameter 14 after all manufacturing operations have been completed. For example, area 13 may be removed by making a cut from false inner diameter 12 to desired inner diameter 14 using an electric discharge wire and then using the wire to cut along desired inner diameter 14. The use of an electric discharge wire in a machining process is well known in the industry.

Another machining process would involve the use of a single point turning tool bit for cutting along desired inner diameter 14. Suitable apparatus for centering disc 10 and removing area 13 so that the finished inner diameter 14 is concentric with outer diameter 11 is disclosed and claimed in copending application Ser. No. 560,533, filed concurrently herewith in the name of Kenneth W. Baun, entitled Method and Apparatus for Disc Position Centering and assigned to Charlton Associates, the assignee of the present invention.

While the invention has been described with respect to the preferred embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A method of manufacturing a rigid computer memory disc where operations may be simultaneously performed on both faces of said disc comprising:

providing a disc with an outer diameter and a false inner diameter which is smaller than a desired inner diameter thereof;

clamping said disc to a spindle using only the area between said false inner diameter and said desired inner diameter thereby leaving the entire area between the outer diameter and the desired inner diameter exposed;

simultaneously performing manufacturing operations on both opposed surfaces of said disc while clamped to said spindle; and subsequently removing said area between said false and desired inner diameters by cutting said disc along said desired inner diameter.

2. A method according to claim 1, wherein said step of simultaneously performing manufacturing operations on both surfaces of said disc includes:

simultaneously finishing said opposed surfaces of said disc.

3. A method according to claim 2, wherein said finishing step comprises:

simultaneously engaging said opposed surfaces of said disc with a pair of abrasive polishing wheels.

4. A method according to claim 3, wherein said polishing wheels are of a diameter so as to overlap the outside diameter of said disc and said desired inner diameter of said disc.

* * * * *